US007788837B2

(12) United States Patent
Binek et al.

(10) Patent No.: US 7,788,837 B2
(45) Date of Patent: Sep. 7, 2010

(54) DEVICE FOR REMOVING RESIDUAL DEBRIS FROM AN INSIDE SURFACE OF A BORE OF A LARGE CALIBER WEAPON AND METHOD OF OPERATING ASSOCIATED THERETO

(76) Inventors: Antoni Binek, 2940 Hill Park Circle, Montréal (CA) H3H 1S9; Jerzy R. Pawulski, 5837 Ave. de la Terrasse, Rawdon (CA) J0K 1S0

( * ) Notice: Subject to any disclaimer, the term of this patent is extended or adjusted under 35 U.S.C. 154(b) by 705 days.

(21) Appl. No.: 11/547,071

(22) PCT Filed: Apr. 13, 2005

(86) PCT No.: PCT/CA2005/000563

§ 371 (c)(1),
(2), (4) Date: Jul. 11, 2007

(87) PCT Pub. No.: WO2005/100902

PCT Pub. Date: Oct. 27, 2005

(65) Prior Publication Data

US 2008/0016747 A1 Jan. 24, 2008

(30) Foreign Application Priority Data

Apr. 14, 2004 (CA) ..... 2464275

(51) Int. Cl.
*F41A 29/00* (2006.01)

(52) U.S. Cl. ..... 42/95; 15/104.16; 15/104.2

(58) Field of Classification Search ..... 42/95; 15/104.16, 104.2
See application file for complete search history.

(56) References Cited

U.S. PATENT DOCUMENTS 3,037,228 A * 6/1962 Cummings ..... 15/104.095
3,814,525 A 6/1974 Spencer
4,290,163 A * 9/1981 Opitz et al. ..... 15/104.09
4,369,071 A * 1/1983 Flach et al. ..... 134/8
4,468,834 A * 9/1984 David ..... 15/246
4,783,925 A 11/1988 Pollock, Jr.

(Continued)

*Primary Examiner*—Troy Chambers
(74) *Attorney, Agent, or Firm*—Robic

(57) ABSTRACT

A device (1) for distributing cleaning solvent (9) in the bore (3) of a barrel (5) of a large caliber weapon. The device (1) comprises an elongated outer casing (11), a distribution assembly (19), a container (25) and a triggering assembly (29). The distribution assembly (19) is mounted into a rear end of the casing (11), and has an inlet (21) for receiving cleaning solvent (9) and an outlet (23) for distributing cleaning solvent. The container (25) comprises a supply of cleaning solvent (9), having a valve (27) connected to the inlet (21) of the distribution assembly (19) for supplying solvent (9) from the container to said distribution assembly (19). The triggering assembly (29) is connected to the container's valve (27) and has a detecting component so as to trigger the valve (27), supplying the distribution assembly (19) with cleaning solvent (9) to be distributed onto the inner surface (7) of the bore (3).

30 Claims, 7 Drawing Sheets

U.S. PATENT DOCUMENTS

| | | | | |
|---|---|---|---|---|
| 4,873,778 | A | | 10/1989 | Stipp |
| 5,233,791 | A | * | 8/1993 | McQueen, Jr. ..... 451/481 |
| 5,245,777 | A | | 9/1993 | Neuman et al. |
| 5,628,136 | A | | 5/1997 | Wickser, Jr. |
| 5,743,040 | A | | 4/1998 | Kennedy |
| 5,815,975 | A | | 10/1998 | Rambo et al. |
| 5,946,843 | A | | 9/1999 | Paananen |
| 5,974,611 | A | | 11/1999 | Casella |
| 6,023,873 | A | | 2/2000 | Baird |
| 6,378,236 | B1 | | 4/2002 | Solberg et al. |
| 6,389,978 | B1 | | 5/2002 | Hooper et al. |
| 6,591,732 | B2 | | 7/2003 | Gerber et al. |
| RE38,247 | E | | 9/2003 | Wickser, Jr. |
| 6,668,480 | B1 | | 12/2003 | Riley |
| 6,701,657 | B1 | | 3/2004 | Hudspeth |
| 6,701,658 | B1 | | 3/2004 | Brownell |
| 7,676,878 | B2 | * | 3/2010 | Parker-Smith ..... 15/104.05 |
| 2004/0074523 | A1 | | 4/2004 | Paananen et al. |

* cited by examiner

FIG. 7a
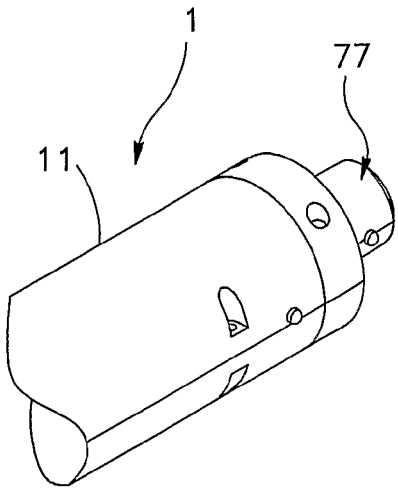
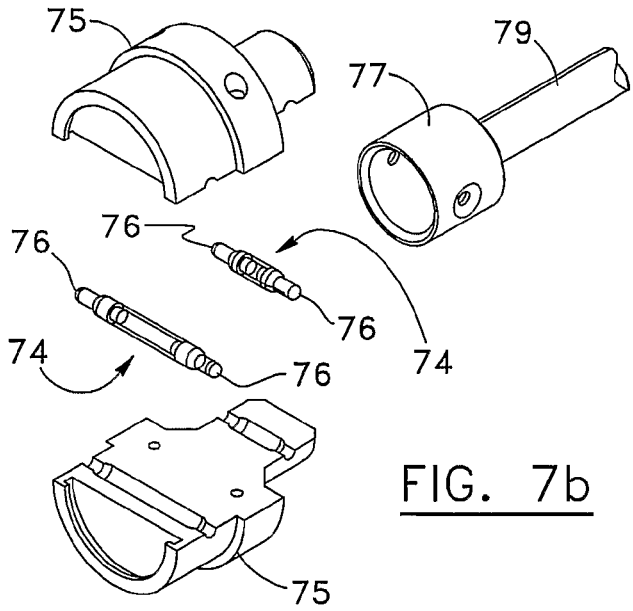
FIG. 7b
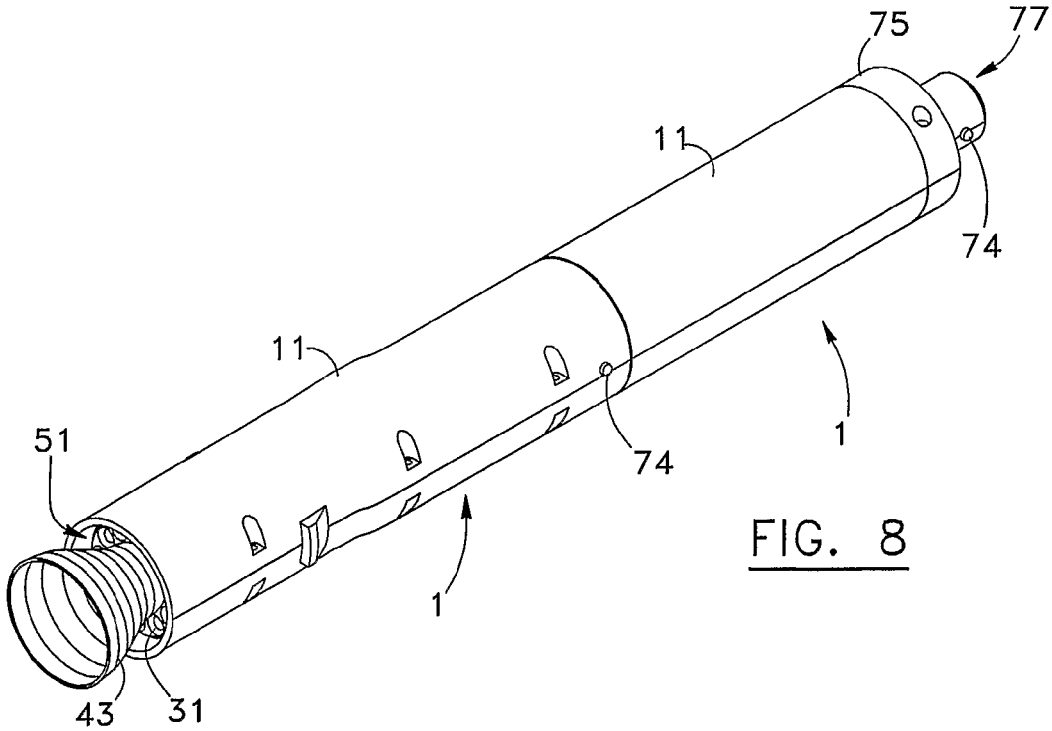
FIG. 8

DEVICE FOR REMOVING RESIDUAL DEBRIS FROM AN INSIDE SURFACE OF A BORE OF A LARGE CALIBER WEAPON AND METHOD OF OPERATING ASSOCIATED THERETO

This application is a 371 of PCT/CA2005/000563 filed Apr. 13, 2005, which claims the priority of Canadian Patent Application No. 2,464,275, filed Apr. 14, 2004, the content of which is incorporated herein by reference.

FIELD OF THE INVENTION

The present invention relates to a device for removing residual debris from an inside surface of a bore of a cylinder, and to a method of operating associated thereto. More particularly, in its preferred intended use, the present invention relates to a device and corresponding method for cleaning medium and large caliber gun barrels, and in particular, for removing copper and propellant residue therefrom.

BACKGROUND OF THE INVENTION

It is well known in the art that the function of a driving band in a projectile is to impart a spin and provide obturation while the projectile is in the bore of a gun. The driving band material is usually a copper alloy which deforms to take the profile of the lands and grooves of the given barrel. This thin layer is augmented with each projectile being fired until an unacceptable thickness is deposited on the inside of the barrel. Such a process of copper being deposited on the rifling of a gun is known as "coppering".

Also known in the art are the following US patents and patent application which describe various devices for cleaning and/or lubricating cylinders, such as barrels of fire weapons and the like: U.S. Pat. Nos. 3,814,525; 4,783,925; 4,873,778; 5,245,777; 5,628,136; 5,743,040; 5,815,975; 5,946,843; 5,974,611; 6,023,873; 6,378,236 B1; 6,389,978 B1; 6,591,732 B2; 6,668,480 B1; 6,701,657 B1; 6,701,658 B1; RE38,247 E; and 2004/0074523 A1.

It is also well known in the art that oxidizing foam has been effectively used in removing copper and propellant residue by filling the entire barrel with foam and waiting for the reaction to take place.

However, it is also known in the art that this method of copper removal also known as "decoppering" has several significant drawbacks when used in medium and large caliber guns. For example, it is well known that, for such applications, the foam effectiveness is substantially hindered as it collapses and tends to create voids, thus resulting in uneven removal of copper residue, which is undesirable for obvious reasons.

Hence, in light of the above-discussed, there is a need for an improved device and/or method which would be able to overcome some of the aforementioned prior art problems.

SUMMARY OF THE INVENTION

The object of the present invention is to provide a device which, by virtue of its design and components, satisfies some of the above-mentioned needs, and which is thus an improvement over other related devices and/or methods known in the prior art.

In accordance with the present invention, the above object is achieved, as will be easily understood, with a device for inserting into a bore of a cylinder to be treated, and for displacing along said bore for removing residual debris from an inner surface of said bore, via an application of cleaning solvent onto said inner surface from the device, the device comprising:

an elongated outer casing having a peripheral outer surface, and opposite front and rear ends, the casing being shaped and sized for inserting into the bore and for displacing along said bore;

a distribution assembly mounted onto the rear end of the casing, the distribution assembly having an inlet for receiving cleaning solvent and an outlet positioned for distributing cleaning solvent onto the inner surface of the bore when the device is inserted into said bore;

a container comprising a supply of cleaning solvent, the container having a valve operatively connected to the inlet of the distribution assembly for supplying cleaning solvent from the container to said distribution assembly, the valve of the container being operable between a closed configuration where cleaning solvent is prevented from exiting the valve of the container, and an opened configuration where cleaning solvent is released from the valve of the container and transmitted to the outlet of the distribution assembly via the inlet thereof; and a triggering assembly operatively connected to the valve of the container, said triggering assembly being mounted about the casing and having a detecting component for detecting when the device is inserted into the bore of the cylinder, so as to thus trigger the valve of the container from the closed configuration into the opened configuration, for supplying the distribution assembly with cleaning solvent to be distributed onto the inner surface of the bore of the cylinder to be treated.

According to another aspect of the invention, there is also provided a method of removing residual debris from an inner surface of a bore of a cylinder to be treated, via an application of cleaning solvent onto said inner surface of the bore, the method comprising the steps of:

a) providing a device such as the one described herein and illustrated in the accompanying drawings; and b) inserting the device into the bore of the cylinder for activating the detecting component of the triggering assembly so as to have the triggering assembly trigger the valve of the container from the closed configuration into the opened configuration, and thus supply the distribution assembly with cleaning solvent to be distributed onto the inner surface of the bore of the cylinder to be treated.

According to yet another aspect of the invention, there is also provided a cylinder having been treated with the above-mentioned device and/or method.

According to yet another aspect of the invention, there is also provided an object, such as a gun for example, provided with the above-mentioned cylinder.

According to yet another aspect of the invention, there is also provided a kit for assembling the above-mentioned device.

The objects, advantages and other features of the present invention will become more apparent upon reading of the following non-restrictive description of preferred embodiments thereof, given for the purpose of exemplification only with reference to the accompanying drawings.

BRIEF DESCRIPTION OF THE DRAWINGS

FIG. 7*a* is a perspective view of the front end of the device shown in FIG. 1.

FIG. 7*b* is an exploded view of an end cap, and a partial perspective view of corresponding locking pins and displacement rod of the device, according to a preferred embodiment of the present invention.

FIG. 8 is a perspective view of the device of FIG. 1 being shown removably connected to an adjoining extension device.

DETAILED DESCRIPTION OF PREFERRED EMBODIMENTS OF THE INVENTION

Figure 1:
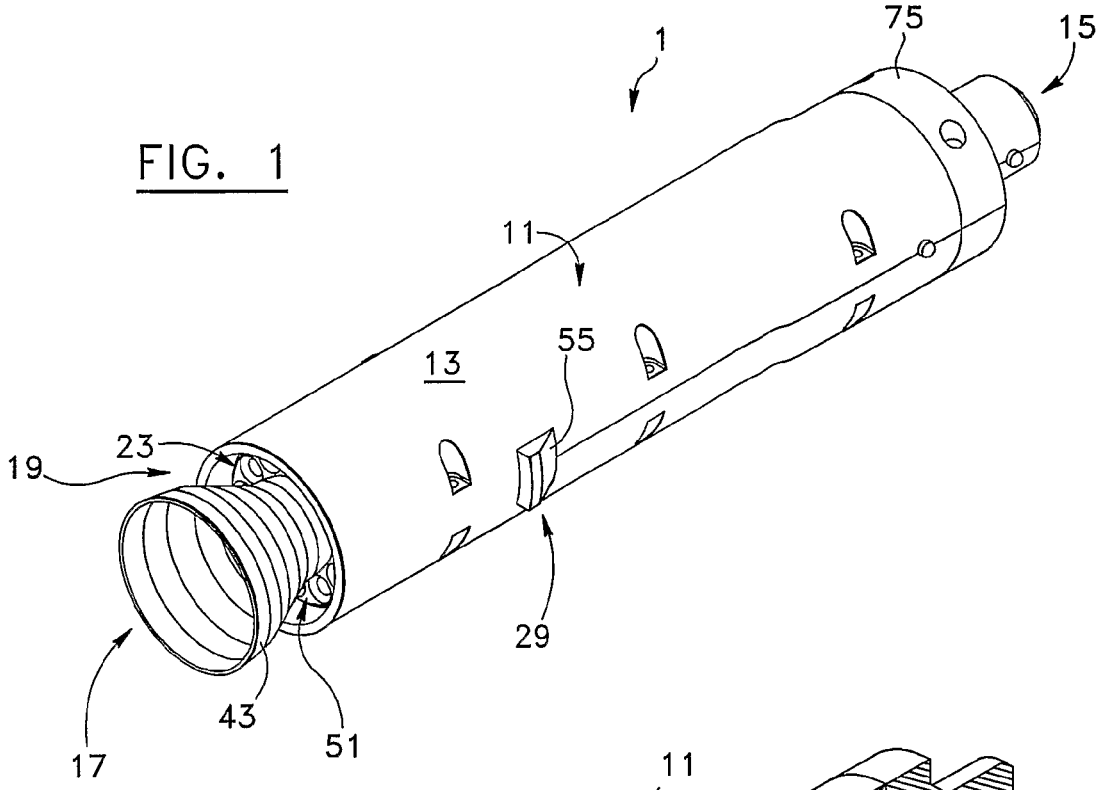
FIG. 1 is a perspective view of a device according to a preferred embodiment of the present invention.

In the following description, the same numerical references refer to similar elements. The embodiments shown in the figures are preferred, and for exemplification purposes only.

Moreover, although the present invention was primarily designed for use for cleaning medium and large caliber gun barrels, it may be used with other types of cylinders and/or objects, and in other fields, such as for cleaning sewerage systems comprising conduits and the like, which could be referred to as "cylinders" according to the present invention, as apparent to a person skilled in the art. For this reason, expressions such as "medium", "large", "gun", "weapon", "firearm" "cannon", "barrel", "cylinder", etc. used herein should not be taken as to limit the scope of the present invention and includes all other kinds of cylinders and/or items with which the present invention could be used and may be useful.

Moreover, in the context of the present invention, the expressions "device", "dispenser", "unit", "apparatus", and any other equivalent expression and/or compound word thereof known in the art will be used interchangeably. Furthermore, the same applies for any other mutually equivalent expressions, such as "barrel" and "cylinder", "gun", "weapon", and "arm", as well as "residue" and "debris" for example, and "treating", "removing", "cleaning" and "dissolving", as also apparent to a person skilled in the art.

In addition, although the preferred embodiment of the present invention as illustrated in the accompanying drawings comprises various components and although the preferred embodiment of the device I as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations therein between, as well as other suitable geometrical configurations may be used for the device 1 and corresponding parts according to the present invention, as briefly explained and inferred herein, without departing from the scope of the invention (for example, it is worth mentioning that the cylinder 5 to be treated with the device 1 according to the present invention need not be of "circular" cross-section, and may take on any other corresponding cross-section, in which case, the device 1, and the corresponding components thereof, are preferably made to be complementary to the bore 3 of such a "non-circular" cylinder 5, as can be easily understood by a person skilled in the art).

The device 1 according to the preferred embodiment of the present invention, as shown in the accompanying drawings, relates to a device 1 for removing copper and propellant residue, in a process known as "decoppering", preferably from medium and large caliber gun barrels, by effective application of oxidizing "foam" or any other suitable cleaning solvent, depending on the particular applications for which it is intended, as apparent to a person skilled in the art, with the use of the device 1 or "dispenser" which applies an optimized thickness of "foam" in a controlled, uniform and compact manner along the inside of the barrel walls. The effective application is considered as a removal or weakening of copper and other unwanted residue that does not necessitate putting the weapon out of action during the decoppering process. The device 1 is preferably constructed with materials and in the manner to avoid deterioration by contact or gases from chemicals contained in the foam and/or residue left in the barrel. According to the present invention, the mechanical damage to the interior surface of the barrel is preferably considered and avoided/minimized in the design, as apparent to a person skilled in the art.

Broadly described, and as better illustrated in the accompanying drawings, the device 1 according to the present invention comprises an elongated outer casing 11, a distribution assembly 19, a container 25, and a triggering assembly 29.

Figure 9A:
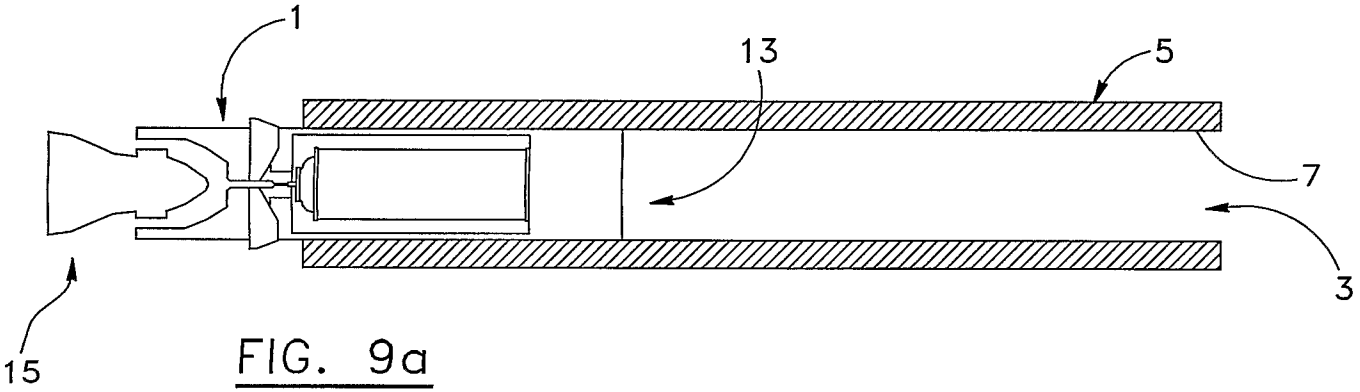
FIGS. 9*a*-9*c* are sequential cross-sectional views of a device operating along an inside surface of a bore of a cylinder according to a preferred embodiment of the present invention.
Figure 9B:
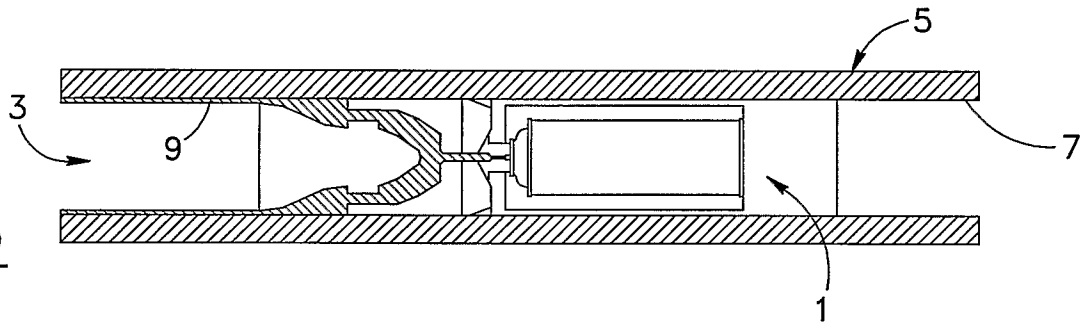
Figure 9C:
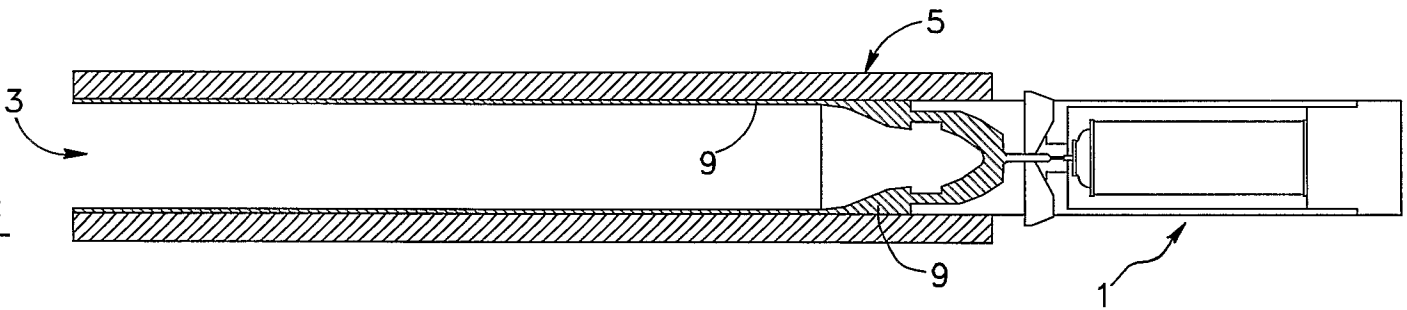
Figure 10:
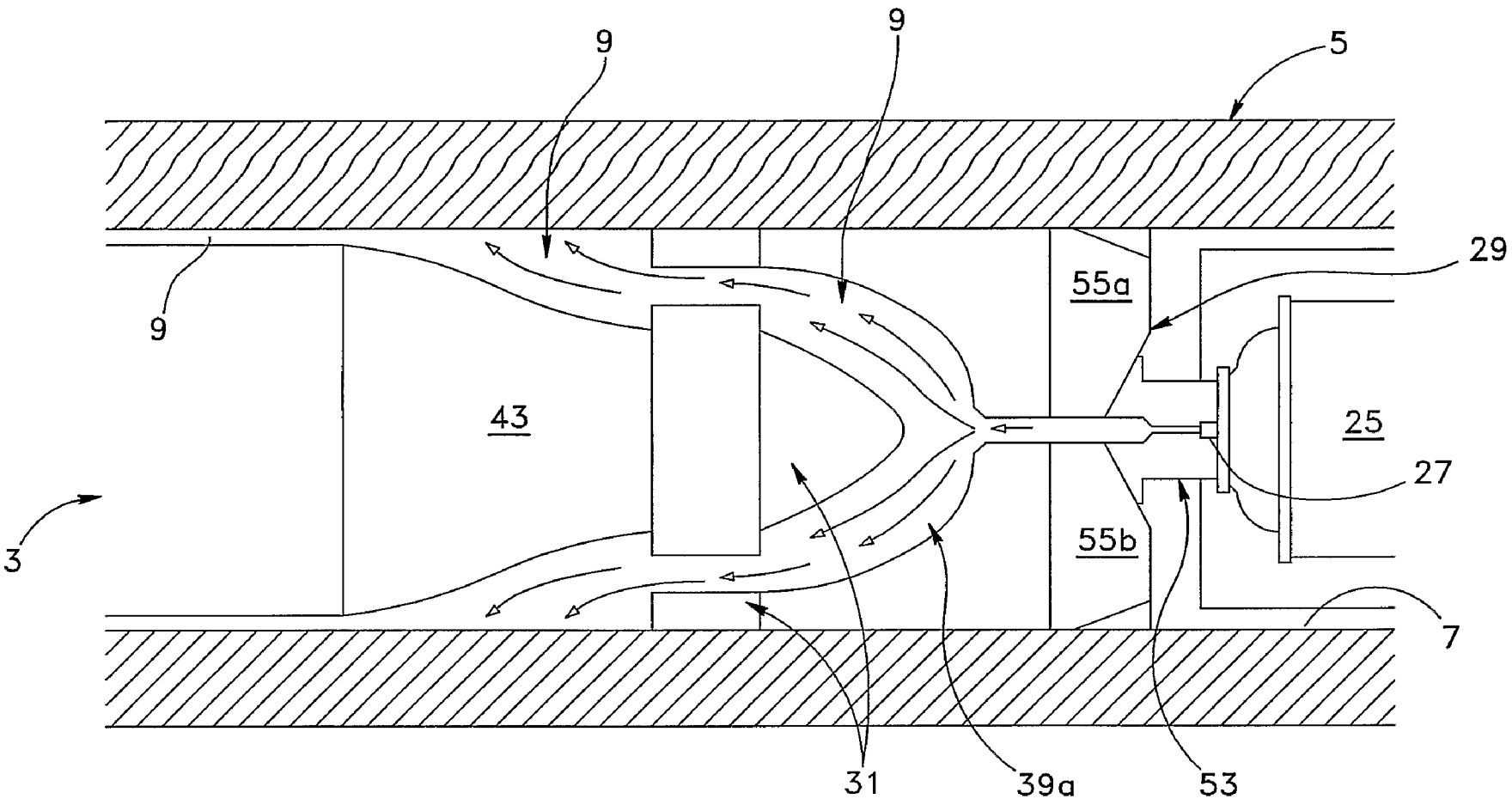
FIG. 10 is a partial schematic cross-sectional view of a portion of a device operating within a cylinder according to another preferred embodiment of the present invention.

As can be easily understood when referring to FIGS. 9-10, the device 1 is used for inserting into a bore 3 of a cylinder 5 (e.g. barrel, etc.) to be treated and for displacing along said bore 3 for removing (e.g. dissolving, weakening, etc.) residual debris (e.g. copper, and/or other unwanted debris) from an inner surface 7 of said bore 3, via an application of cleaning solvent 9 (e.g. "foam") onto said inner surface 7 from the device 1.

Figure 2:
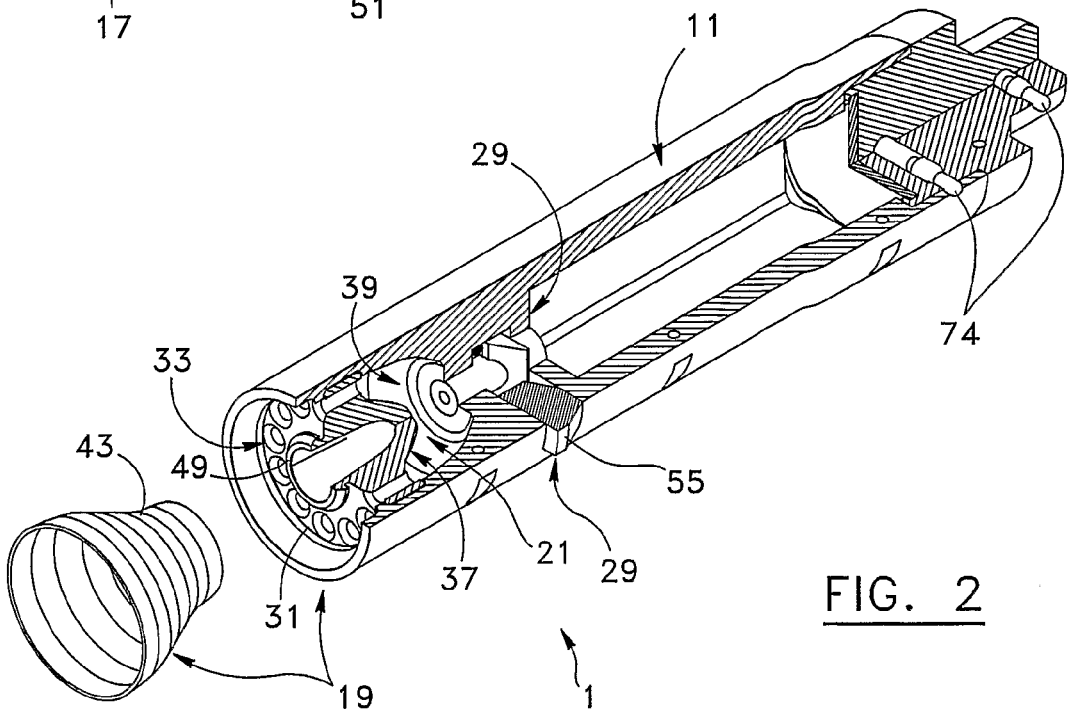
FIG. 2 is a partly cut away perspective view of what is shown in FIG. 1, the device being now shown with a deflector of the distribution assembly in an exploded relationship with a nozzle of said distribution assembly.
Figure 3:
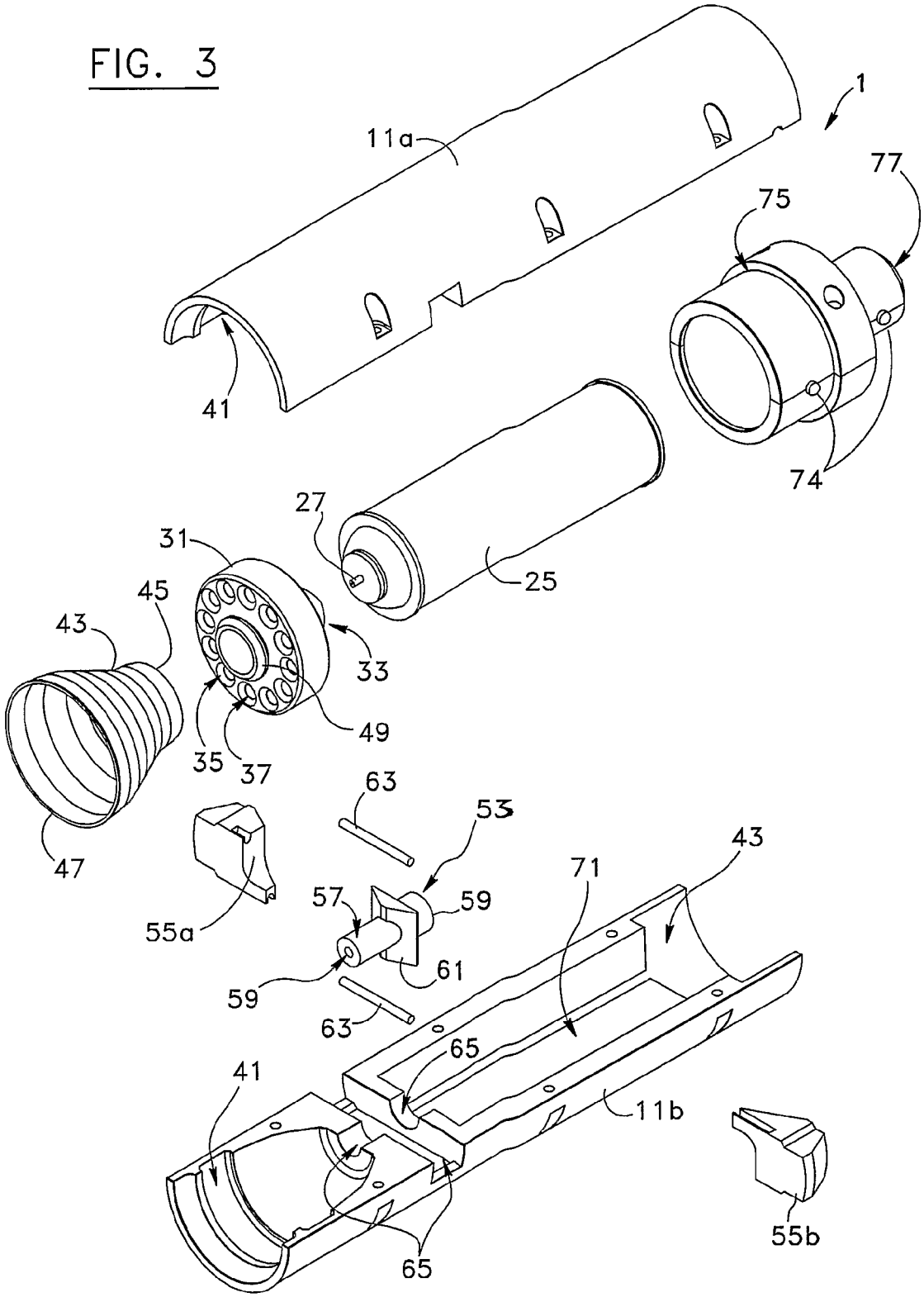
FIG. 3 is an exploded view of what is shown in FIG. 1, better illustrating the different components of the device according to the preferred embodiment of the present invention.

As better shown in FIGS. 1-3, the elongated outer casing 11 preferably has a peripheral outer surface 13, and opposite front and rear ends 15, 17, and is shaped and sized for inserting into the bore 3 and for displacing along said bore 3. It is to be understood that different types and sizes of casings 11 may be used according to the present invention, in order to treat and clean different types of cylinders 5, whether of circular cross-section or not.

Furthermore, according to the present invention, the distribution assembly 19 is preferably mounted onto the rear end 17 of the casing 11, and has an inlet 21 for receiving cleaning solvent 9 and an outlet 23 positioned for distributing cleaning solvent 9 onto the inner surface 7 of the bore 3 when the device 1 is inserted into said bore 3. As will be explained in greater detail herein below, an important aspect of the present invention resides in that it comprises a "detecting component" for detecting when the device 1 is inserted into a given bore 3 of a cylinder 5 to be treated, and thus "automatically" triggering the distribution assembly 19 so as to have cleaning solvent 9 distributed onto the inner surface 7 of the bore 3 of the cylinder 5 to be treated, as the device 1 is displaced along said bore 3. It is worth mentioning however that for a more sophisticated device 1, the distribution assembly 19 could be triggered by other suitable means, and/or remotely, as apparent to a person skilled in the art.

As better shown in FIG. 3, and according to the present invention, the container 25 comprises a supply of cleaning solvent 9, and has a valve 27 operatively connected to the inlet 21 of the distribution assembly 19 for supplying cleaning solvent 9 from the container 25 to said distribution assembly 19, the valve 27 of the container 25 being operable between a closed configuration where cleaning solvent 9 is prevented from exiting the valve 27 of the container 25, and an opened configuration where cleaning solvent 9 is released from the valve 27 of the container 25 and transmitted to the outlet 23 of the distribution assembly 19 via the inlet 21 thereof. As can be easily understood by a person skilled in the art, the valve 27 of the container 25 according to the preferred embodiment of the present invention is generally in a closed configuration by default, that is, is generally in a closed configuration, unless otherwise triggered to be operated into an opened configuration by suitable means, such as the triggering assembly 29.

The triggering assembly 29 is operatively connected to the valve 27 of the container 25, and is preferably mounted about the casing 11, and preferably has a movable portion projecting from the outer surface 13 of said casing 11 for "detecting" when the device 1 is inserted into the bore 3 of the cylinder 5, and thus triggering the valve 27 of the container 25 from the closed configuration into the opened configuration, for supplying the distribution assembly 19 with cleaning solvent 9 to be distributed onto the inner surface 7 of the bore 3 of the cylinder 5 to be treated, as mentioned above.

Preferably, and as better shown in FIGS. 1-4, the distribution assembly 19 comprises a nozzle 31 having an inlet 33 operatively connected to the valve 27 of the container 25 and an opposite outlet 35 positioned about the casing 11 for distributing cleaning solvent 9 onto the inner surface 7 of the bore 3, preferably, out from the rear end 17 of the casing 11. It is worth mentioning however that according to the present invention, the distribution assembly 19 could be devised so as to distribute cleaning solvent 9 onto the inner surface 7 in another way, such as, for example, via a corresponding portion of the outer surface 13 of the casing 11, that is, through the "side" of the casing 11, rather than by the preferred "rear end" of the casing 11, as apparent to a person skilled in the art. In such a case, the casing 11 and corresponding distribution assembly 19, including the components thereof, would be modified accordingly, as also apparent to a person skilled in the art.

Figure 4:
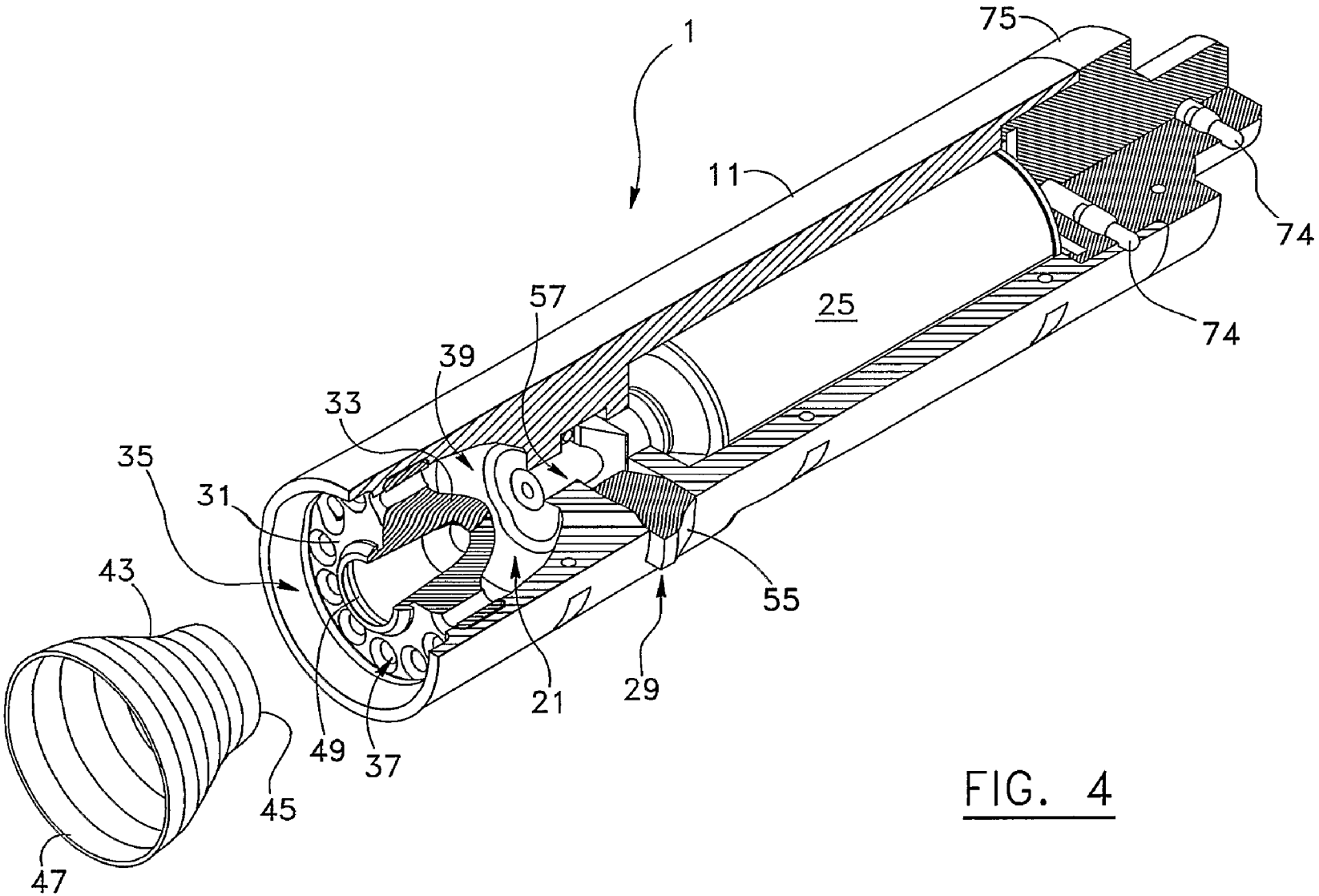
FIG. 4 is an enlarged view of what is shown in FIG. 2, the device being shown in pre-operative position, corresponding to the valve of the container being in a closed configuration.

Preferably, as better shown in FIG. 4, the nozzle 31 comprises several channels 37 extending between the inlet 33 and the outlet 35 of the nozzle 31, about a longitudinal axis of said nozzle 31. Preferably also, the nozzle 31 is positioned in a chamber 39 defined within the casing 11, adjacent to the rear end 17 thereof. The chamber 39 of the casing 11 thus preferably comprises a corresponding groove 41 for receiving the nozzle 31, as better shown in FIG. 3.

As can be easily understood when referring to FIGS. 4 and 10, the nozzle 31 according to the preferred embodiment of the present invention has separate channels 37, wherein inlets thereof are preferably fed with cleaning solvent 9 at the corresponding portion of the chamber 39, namely, the mixing chamber 39*a*, better illustrated in FIG. 10, which is filled with such cleaning solvent 9 by the container 25 when the valve 27 is triggered into an opened configuration via the triggering assembly 29. However, it is worth mentioning also that the nozzle 31 and the corresponding channels 37 thereof may take on other suitable embodiments without departing from the scope of the present invention, as apparent to a person skilled in the art. Indeed, for example, the nozzle 31 may be modified so as to have one single common inlet into which cleaning solvent 9 would be supplied by the valve 27 of the container 25, said common inlet being then separated into various sub-channels 37 disposed about the longitudinal axis of the nozzle 31, so as to have outlets of channels 37 all around the nozzle 31, as illustrated in FIGS. 3 and 4.

Referring back to FIGS. 1-4, the distribution assembly 19 also preferably comprises a deflector 43 for deflecting onto the inner surface 7 of the bore 3 cleaning solvent 9 exiting from the outlet 35 of the nozzle 31 (i.e. from the outlets of the channels 37 of the nozzle 31). As can be easily understood when contrasting FIGS. 1 and 2, the deflector 43 according to the present invention is preferably removably mountable onto the nozzle 31.

Preferably also, the deflector 43 is of substantially frusto-conical shape and has opposite first and second rims 45, 47, the first rim 45 being removably mountable onto a corresponding flange 49 provided on the nozzle 31, and the second rim 47 extending beyond the rear end 17 of the casing 11 and having a smaller diameter than that of the bore 3 of the cylinder 5, so as to define a predetermined gap 51 between the second rim 47 of the deflector 43 and the inner surface 7 of the bore 3, whereby cleaning solvent 9 is applicable from the distribution assembly 19 and onto the inner surface 7 of the bore 3 via said gap 51.

Preferably also, the deflector 43 has a curvilinear outer surface extending between the first and second rims 45, 47, as better shown in FIG. 4, and the outer surface of the deflector 43 is preferably a smooth surface. It is North mentioning also that the outer surface of the deflector 43 may, according to other embodiments of the present invention, have other suitable configurations, such as segmented sections, for example, depending on the particular applications and the end results intended with the deflector 43 and/or the device 1, as apparent to a person skilled in the art.

According to the preferred embodiment of the present invention, and as better illustrated in FIGS. 1-6, and as can be easily understood when referring to FIGS. 9-10, the triggering assembly 29 comprises a push button assembly having movable inner and outer components 53, 55 being operatively connected to each other, the inner component 53 being operatively connected to the valve 27 of the container 25 for cooperation therewith, and the outer component 55 (i.e. the "detecting component" according to this particular preferred embodiment) having a portion projecting from the outer surface 13 of the casing 11, the inner and outer components 53, 55 being positioned, shaped and sized about the casing 11 so that when the casing 11 is inserted into the bore 3, the inner surface 7 of said bore 3 pushes against the outer component 55 of the triggering assembly 29 thereby in turn pushing against the inner component 53 so as to trigger the valve 27 of the container 25 into the opened configuration, and thus have cleaning solvent 9 supplied from the valve 27 to the inlet 21 of the distribution assembly 19, for distributing in turn cleaning solvent 9 via the outlet 23 of the distribution assembly 19 onto the inner surface 7 of the bore 3 as the device is displaced along said bore 3.

Preferably also, and as better shown in FIG. 3, the inner component 53 of the triggering assembly 29 comprises a piston 57 movable along a longitudinal axis of the casing 11, said piston 57 comprising a conduit 59 being connectable between the valve 27 of the container 25 and the inlet 21 of the distribution assembly 19, as better shown in FIG. 10. According to the preferred embodiment of the present invention, the device is preferably made symmetrical, and thus, the longitudinal axis of the nozzle and the longitudinal axis of the casing are preferably aligned with each other, as can be easily understood when referring to FIG. 4 for example.

Furthermore, it is worth mentioning that in the case of a single inner component 53 and a single outer component 55, these two (2) components 53,55 could be made integral to each other, that is, made of a single piece, and of a single material, so as to have a single "push button" connected to the valve 27 of the container 25.

Figure 5:
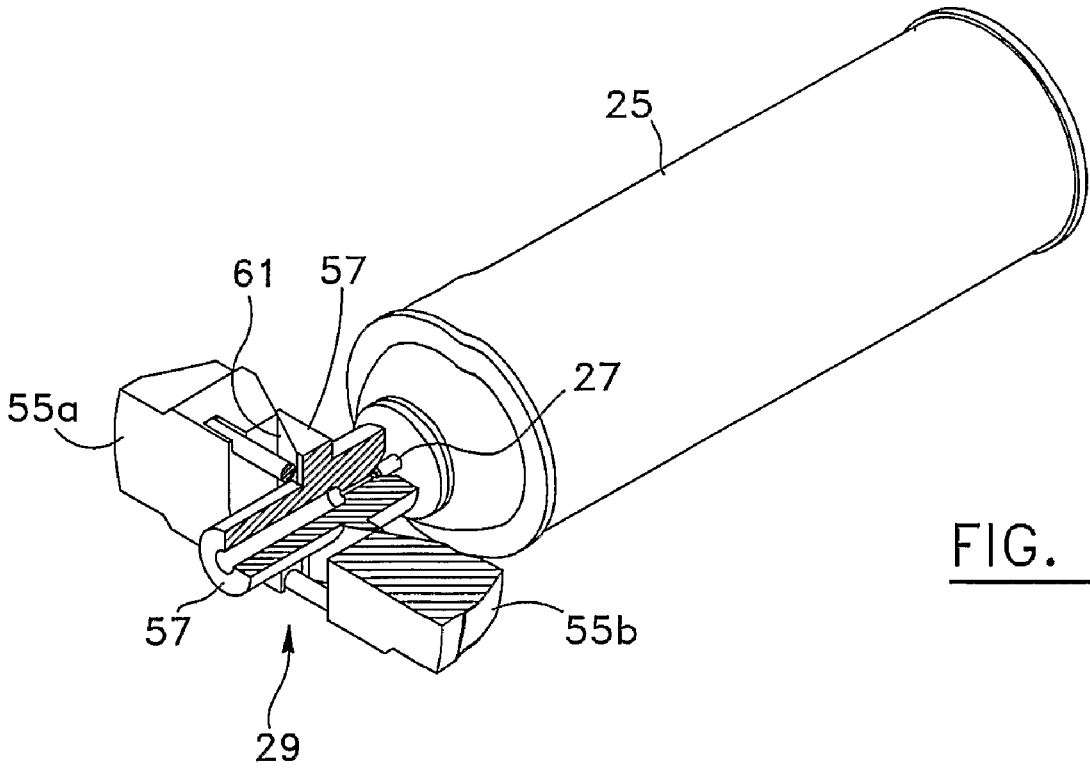
FIG. 5 is an enlarged detailed cross-sectional partly cut away view of a triggering assembly shown in a pre-operative position, cooperating with a container, according to a preferred embodiment of the present invention.

As also better shown in FIG. 3, the piston 57 is preferably provided with a least one cam surface 61 positioned, shaped and sized for cooperating with the outer component 55 of the triggering assembly 29 so as to in turn trigger the valve 27 of the container 25, via said piston 57, into an opened configuration, when the outer component 55 is pushed into the casing 11 by the inner surface 7 of the bore 3 when the device 1 is inserted into said bore 3, and in turn against the piston 57 of the inner component 53, as can be easily understood when contrasting FIGS. 4 and 5, and when referring to FIGS. 9*a*-9*c*.

Figure 6:
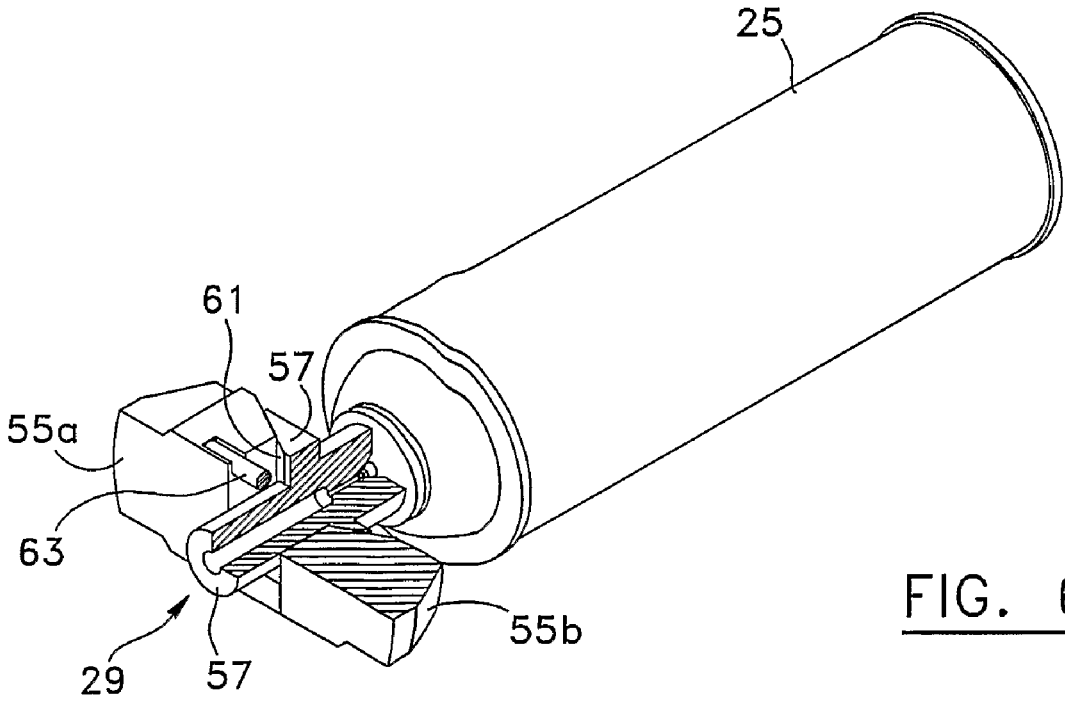
FIG. 6 is another view of what is shown in FIG. 5, the triggering assembly being now shown in an operative position, corresponding to the valve of the container being operated into an opened configuration.

As previously mentioned, the device 1 according to the present invention is preferably made symmetrical, for obvious reasons and advantages known in the art, and thus, the piston 57 is preferably provided with a pair of cam surfaces 61, and the triggering assembly 29 preferably comprises first and second outer components 55*a*,55*b*, each outer component 55 cooperating with a corresponding cam surface 61 of the piston 57, as can be easily understood when referring to FIGS. 3, 5 and 6.

As illustrated, the triggering assembly 29 preferably also comprises biasing means 63 operatively positioned between the first and second outer components 55*a*,55*b* for biasing said outer components 55 away from each other so that each outer component 55 has a movable portion projecting from the outer surface 13 of the casing 11. Preferably also, the first and second outer components 55*a*,55*b* are positioned diametrically opposite to one another onto the casing 11. Preferably also, the biasing means 63 are small springs 63 which are inserted into corresponding grooves, and between the first and second outer components 55*a*,55*b*, also referred to as "switches", for insuring that a portion of each outer component 55*a*,55*b* projects from out of a corresponding outer surface 13 of the casing 11, as explained above, when referring to the triggering assembly 19.

As better shown in FIG. 3, the casing 11 preferably comprises recesses 65 for receiving the inner and outer components 53,55, and also comprises first and second parts 67, 69 being removably connectable to each other for forming the casing 11 and corresponding recesses thereof. Preferably also, the container 25 is lodged in a housing 71 defined within the casing 11 and the casing 11 has an opening 73 provided onto the front end 15 of the casing 11, operatively connected to the housing 71 of the casing 11, for receiving the container 25 into the housing 71 through said opening 73.

Preferably also, and as can be easily understood when referring to FIGS. 1 and 3, the device 1 comprises an end cap 75 being removably insertable into the opening 73 of the casing 11 for securing the container into the housing 71. According to the preferred embodiment of the present invention, the end cap 75 is removably lockable onto the casing 11 by suitable means, such as locking pins 74, which may be provided with spring biased ends 76, as exemplified in FIG. 7*b*. Other suitable means could be used for removably locking the end cap 75 onto the casing 11, as apparent to a person skilled in the art.

Preferably, the end cap 75 is provided with a connection portion 77 for removably connecting the end cap 75 onto another component, such as a displacement rod 79 for example, which can be used for displacing the device 1 along the bore 3. Other means, such as driving means, could be used for displacing the device 1 along the bore 3, as also apparent to a person skilled in the art). The connection portion 77 may also be used for receiving other adjoining devices, such as mechanical extensions, or other devices 1 provided with replacement containers 25, as exemplified in FIG. 8, which could be added to the first main 1, for various reasons and purposes, prior to removably connecting the displacement rod 79 onto the similar connection portion 77 of such an adjoining device 1.

Indeed, as can be easily understood from the above-described, and as apparent to a person skilled in the art, several modifications could be made to the present device 1, and to the various preferred components/embodiments thereof, without departing from the scope of the present invention. Indeed, as briefly mentioned above, and as can be easily inferred from the present description, by a person skilled in the art, various other ways and/or suitable means could be used in order to displace the present device 1 along the bore 3 of a given cylinder 5 to be treated. For example, in the case of a substantially smaller barrel 3, the device 1 could be inserted therein, and the barrel 3 could then be slightly tilted accordingly so as to have the effect of gravity displace the device 1 along the barrel 3. However, for medium-sized and larger-sized gun barrels, instead of using the above-described displacement rod 79, more sophisticated driving means could be used for mechanically or remotely driving the device 1 along the bore 3 of the cylinder 5 to be treated. Indeed, it is worth mentioning also that these driving means could be mounted onto the device 1 and may be designed so as to cooperate with the inner surface 7 of the barrel 3 so as to displace the device 1 there along, in a suitable manner, such as with powered wheel assemblies, etc., as apparent to a person skilled in the art. Moreover, driving means which do not need to cooperate with the inner surface 7 of the bore 3 and which are self-propelled, could also be used and mounted onto the present device 1 so as to, via a propulsion action provided by such driving means, have the device 1 displaced along the bore 3 of the cylinder 5, as also apparent to a person skilled in the art. Thus, it may be better appreciated that various different types of driving means, whether manually operated (e.g. displacement rod 79), mechanically driven (e.g. powered wheels) or self-propelled, or simply by using the effect of gravity by tilting the barrel, may be employed for displacing the device 1 along the barrel 3 of the cylinder 5 to be treated.

It is worth mentioning also that depending on the size of the cylinder 5 to be treated, the present device 1 could also be modified in order to comprise a plurality of containers 25 which would be disposed and cooperate with the triggering assembly 29 in a corresponding and suitable manner, as apparent to a person skilled in the art, so as to further provide cleaning solvent 9 to the device 1 in the event of the depletion of a first container 25, and depending on the particular area of the inner surface 7 of the bore 3 of the cylinder 5 to be treated, and the corresponding amount of foam required, as also apparent to a person skilled in the art.

Preferably, the container 25 used with the present device 1 is a pressurized container 25 and the cleaning solvent 9 is a cleaning foam 9, intending for removing, cleaning, and/or at the very least, weakening, via dissolving, and the like, debris present along the inner surface 7 of a given bore 3, as is well known in the art.

According to another aspect of the present invention, there is also provided a method of removing residual debris from an inner surface 7 of a bore 3 of a cylinder 5 to be treated, via an application of cleaning solvent 9 onto said inner surface 7 of the bore 3. The method comprising the steps of a) providing a device 1 such as the one described herein and exemplified in the accompanying drawings; and b) inserting the device 1 into the bore 3 of the cylinder 5 for activating the detecting component of the triggering assembly 29 so as to have the triggering assembly 29 trigger the valve 27 of the container 25 from the closed configuration into the opened configuration, and thus supply the distribution assembly 19 with cleaning solvent 9 to be distributed onto the inner surface 7 of the bore 3 of the cylinder 5 to be treated.

Preferably, the method further comprises the step of c) displacing the device 1 along the bore 3 of the cylinder 5 so as to distribute cleaning solvent 9 along a section of the bore 3 (preferably, the entire length of the bore 3, as shown in FIGS. 9-10) where the distribution assembly 19 has been displaced.

Preferably also, step c) comprises the step of displacing the device 1 along the bore 3 with a displacement rod 79 removably connected to a corresponding end of the device 1, preferably by means of the connection portion 77 and corresponding locking pins 74.

According to another aspect of the present invention, there is also provided a cylinder 5 comprising a bore 3 having been treated with a device and/or a method such as the ones described herein and exemplified in the accompanying drawings. Such cylinder 5 may include, not only the barrel itself, but also the entire corresponding weapon (gun, riffle, cannon, and the like).

According to yet another aspect of the present invention, there is also provided a kit for assembling a device such as the one briefly described herein and exemplified also in the accompanying drawings.

As previously mentioned, and as better illustrated in the accompanying drawings, the application device 1 according to the present invention is preferably composed of an outer cylindrical casing 11 containing therein a replaceable foam pressurized container 25, and provided with an enclosed end cap 75 which is preferably opened and removed from said casing 11 via a simple and fast hand maneuver of the corresponding cup which preferably has a relatively flexible compression surface for abutment against the bottom side of container 25. As previously mentioned, locking pins 74 are preferably used for connection of the end cap 75 with the casing 11 and for allowing to manually lock the end cap 75 not only onto the casing 11, but also, via the connection portion 77, to a corresponding component, such as a displacement rod 79, which can be used for displacing more easily the device 1 along a given bore 3 of cylinder 5, particularly when said cylinder 5 is substantially long. As for the displacement rod 79 to be used, it is worth mentioning that it may consist of a standard barrel's cleaning rod, preferably equipped at one end with a fast connecting device compatible with a fast locking attachment of the end cap 75 of the device 1 according to the present invention. Also according to the present invention, the displacement rod 79 is preferably attached onto the front end 15 of the device 1, and thus, the distribution assembly 19 for distributing or dispensing cleaning solvent 9 provided from the valve 27 of the container 25 is preferably provided onto the rear end 17 of the device 1, as exemplified in the accompanying drawings.

Preferably also, the foam container orifice is pointed out and aligned with the corresponding small diameter conduit hole in the center of the movable piston valve equipped preferably with cams, or cam shaped surfaces 61, destined to cooperate with their neighboring proximity switches (first and second outer components 55), which are preferably located on opposite sides of the casing 11, as explained hereinabove.

As can be easily understood when referring to FIGS. 9-10, when the application device 1 is introduced into the bore 3 (e.g. barrel), the proximity switches are preferably pushed inwards exercising pressure on the cams being the part of the piston 57 and by this action move the piston 57 towards the foam container 25, opening the valve 27 of container 25 and releasing the foam in the mixing chamber 39*a*.

The main function of the mixing chamber 39*a* is to equalize the foam density on the perimeter of the end side of the chamber 39, the one equipped with uniformly located orifices or channels 37 permitting the foam to move freely and transfer from the mixing chamber 39*a* into the space or gap 51 defined between the inside barrel surface 7 and shaped deflector or "applicator" surface. Preferably, the smooth surface of the deflector 43 allows the foam to be compressed and applied to the barrel surface 7, resulting in the provision of a uniform optimized thickness layer of a given density, as exemplified in FIGS. 9-10.

Moving the application unit along the barrel at optimized speeds and in a direction opposite to the nozzle 31 results in the deposit of an integral foam skin on the inner surface 7 of the barrel.

When the unit reaches the other end of the barrel, the proximity switches 55*a*,55*b* are no longer in contact with the inside of the barrel surface, and extend outwardly under the joint spring action of the compressed gas and the small springs 63 inserted between switches 55, thus releasing the piston 57 from its compressed position, and by the same effect, stopping the flow of foam coming from the pressurized container 25.

After application of foam in the total length of the barrel is completed, the device 1 is removed from the barrel, disconnected from the pulling rod 79, and washed with water or an appropriated cleaning agent, in order to be used for the next application.

The pressurized foam container 25 should be preferably removed from the housing 71 prior to the cleaning process, disposed of, or if not completely depleted from its supply of cleaning solvent, reinstalled into the housing, after cleaning, for another subsequent application, as apparent to a person skilled in the art.

In the meantime, the chemical reaction between the foam and the residues takes place in the barrel, and copper and propellant residues are removed (i.e. dissolved, weakened, broken down, etc.) from the barrel's surface 7. Preferably, mechanical and traditional cleaning by the use of brushes and rugs completes the decoppering process and results in an evacuation of the residual foam, copper and other particles from the bore 3 (i.e. barrel).

As may now be appreciated, the present invention is a substantial improvement over the prior art in that, by virtue of its design and components, the device is very simple and easy to use, as well as is very simple and easy to manufacture and/or assemble, without compromising the reliability of its functions. Hence, it may now be appreciated that the present invention represents important advantages over other decoppering devices and/or methods known in the prior art, in terms of performance and in terms of costs.

The present invention is also an improvement and presents several advantages over other devices known on the prior art in that it is a more compact, more reliable, easier to use, easier to maintain, and more cost effective device than those available in the prior art. Furthermore, the present invention may be used with other kinds of cylinders, and in other fields, as mentioned above and as apparent to a person skilled in the art.

The present invention is also an improvement arid presents several advantages over other decoppering devices and/or methods known in the prior art in that, as may now be appreciated from the present description and accompanying drawings, the present invention enables; the following: a) application of the decoppering agent through the dispenser device 1 ensures that the down time of the weapon is restricted to a minimum, decoppering process can be thus interrupted at any time and the weapon will be in "ready to fire" condition within about one (1) minute, preferably after interruption of the process; b) application of the decoppering agent oxidizer through the dispenser device 1 allows for controlled chemical reaction, this controlled reaction is preferably achieved through a designated thickness of the foam oxidizer as applied to the inside of the barrel—controlled reaction results in better understanding of the decoppering process, which ultimately allows for better ammunition design; c) application of the oxidizing agent through the dispenser device 1 allows for maximum efficiency of oxidization and thus minimizes waste and pollution; d) the form of the application deflector 43 is preferably obtained by rotating about 360 degrees a defined continuous curve around an imaginary axis superimposed with the barrel's longitudinal axis; e) orifices in the wall of the mixing chamber 39*a* are preferably of equal section, and are uniformly spaced on an imaginary circle and when inserted in the barrel—they are preferably at the same distances from the barrel's interior surface 7; f) on board foam mixing; g) different types of triggers other than proximity switches 55 can be used; h) manually operated for action of displacement by pulling rod 49, and/or any other means, when inserted in the barrel; i) mechanically operated for displacement, see as exterior or internal propulsion devices; and j) allows for one or more foam canisters 25 in the described device 1.

Of course, numerous modifications could be made to the above-described embodiments without departing from the scope of the invention, as defined in the appended claims.

The invention claimed is:

1. A device for inserting into a bore of a cylinder to be treated, and for displacing along said bore for removing residual debris from an inner surface of said bore, via an application of cleaning solvent onto said inner surface from the device, the device comprising:

an elongated outer casing having a peripheral outer surface, and opposite front and rear ends, the casing being shaped and sized for inserting into the bore and for displacing along said bore;

a distribution assembly mounted onto the rear end of the casing, the distribution assembly having an inlet for receiving cleaning solvent and an outlet positioned for distributing cleaning solvent onto the inner surface of the bore when the device is inserted into said bore;

a container comprising a supply of cleaning solvent, the container having a valve operatively connected to the inlet of the distribution assembly for supplying cleaning solvent from the container to said distribution assembly, the valve of the container being operable between a closed configuration where cleaning solvent is prevented from exiting the valve of the container, and an opened configuration where cleaning solvent is released from the valve of the container and transmitted to the outlet of the distribution assembly via the inlet thereof; and a triggering assembly operatively connected to the valve of the container, said triggering assembly being mounted about the casing and having a detecting component for detecting when the device is inserted into the bore of the cylinder, so as to thus trigger the valve of the container from the closed configuration into the opened configuration, for supplying the distribution assembly with cleaning solvent to be distributed onto the inner surface of the bore of the cylinder to be treated.

2. A device according to claim 1, wherein the distribution assembly comprises a nozzle having an inlet operatively connected to the valve of the container and an opposite outlet positioned about the casing for distributing cleaning solvent onto the inner surface of the bore.

3. A device according to claim 2, wherein the nozzle comprises several channels extending between the inlet and the outlet of the nozzle, about a longitudinal axis of said nozzle.

4. A device according to claim 2, wherein the nozzle is positioned in a chamber defined within the casing, adjacent to the rear end thereof.

5. A device according to claim 4, wherein the chamber of the casing comprises a corresponding groove for receiving the nozzle.

6. A device according to claim 2, wherein the distribution assembly further comprises a deflector for deflecting onto the inner surface of the bore cleaning solvent exiting from the outlet of the nozzle.

7. A device according to claim 6, wherein the deflector is removably mountable onto the nozzle.

8. A device according to claim 6, wherein the deflector is substantially frusto-conical and has opposite first and second rims, the first rim being removably mountable onto a corresponding flange provided on the nozzle, and the second rim extending beyond the rear end of the casing and having a smaller diameter than that of the bore of the cylinder, so as to define a predetermined gap between the second rim of the deflector and the inner surface of the bore, whereby cleaning solvent is applicable from the distribution assembly and onto the inner surface of the bore via said gap.

9. A device according to claim 8, wherein the deflector has a curvilinear outer surface extending between the first and second rims.

10. A device according to claim 9, wherein the outer surface of the deflector is smooth.

11. A device according to claim 1, wherein the triggering assembly comprises a push button assembly having movable inner and outer components being operatively connected to each other, the inner component being operatively connected to the e valve of the container for cooperation therewith, and the outer component having a portion projecting from the outer surface of the casing, the inner and outer components being positioned, shaped and sized about the casing so that when the casing is inserted into the bore, the inner surface of said bore pushes against the outer component of the triggering assembly thereby in turn pushing against the inner component so as to trigger the valve of the container into the opened configuration, and thus have cleaning solvent supplied from the valve to the inlet of the distribution assembly, for distributing in turn cleaning solvent via the outlet of the distribution assembly onto the inner surface of the bore.

12. A device according to claim 11, wherein the inner component of the triggering assembly comprises a piston movable along a longitudinal axis of the casing, said piston comprising a conduit being connectable between the valve of the container and the inlet of the distribution assembly.

13. A device according to claim 12, wherein the piston is provided with a least one cam surface positioned, shaped and sized for cooperating with the outer component of the triggering assembly so as to in turn trigger the valve of the container, via said piston, into an opened configuration, when the outer component is pushed into the casing by the inner surface of the bore when the device is inserted into said bore, and in turn against the piston of the inner component.

14. A device according to claim 13, wherein the piston is provided with a pair of cam surfaces, and wherein the triggering assembly comprises first and second outer components, each outer component cooperating with a corresponding cam surface of the piston.

15. A device according to claim 14, wherein the triggering assembly comprises biasing means operatively positioned between the first and second outer components for biasing said outer components away from each other so that each outer component has a movable portion projecting from the outer surface of the casing.

16. A device according to claim 14, wherein the first and second outer components are positioned diametrically opposite to one another onto the casing.

17. A device according to claim 11, wherein the casing comprises recesses for receiving the inner and outer components.

18. A device according to claim 1, wherein the casing comprises first and second parts being removably connectable to each other for forming the casing and corresponding recesses thereof.

19. A device according to claim 1, wherein the container is lodged in a housing defined within the casing.

20. A device according to claim 19, wherein the casing has an opening provided onto the front end of the casing, operatively connected to the housing of the casing, for receiving the container into the housing through said opening.

21. A device according to claim 20, wherein the device comprises an end cap being removably insertable into the opening of the casing.

22. A device according to claim 21, wherein the end cap is removably lockable onto the casing.

23. A device according to claim 21, wherein the end cap is provided with a connection portion for removably connecting the end cap onto another component.

24. A device according to claim 1, wherein the container is a pressurized container and where in the cleaning solvent is an oxidizing foam.

25. A method of removing residual debris from an inner surface of a bore of a cylinder to be treated, via an application of cleaning solvent onto said inner surface of the bore, the method comprising the steps of:

a) providing the device as defined in claim 1; and b) inserting the device into the bore of the cylinder for activating the detecting component of the triggering assembly so as to have the triggering assembly trigger the valve of the container from the closed configuration into the opened configuration, and thus supply the distribution assembly with cleaning solvent to be distributed onto the inner surface of the bore of the cylinder to be treated.

26. A method according to claim 25, wherein the method further comprises the step of:

e) displacing the device along the bore of the cylinder so as to distribute cleaning solvent along a section of the bore where the distribution assembly has been displaced.

27. A method according to claim 26, wherein step c) comprises the step of displacing the device along the bore with a displacement rod removably connectable to a corresponding end of the device.

28. A method according to claim 26 or 27, wherein said section comprises the entire length of the bore.

29. A cylinder comprising a bore having been treated with the method defined in claim 25.

30. A kit comprising an elongated outer casing, a distribution assembly, a container, and a triggering assembly, to be connected onto one another for assembling the device of claim 1.

* * * * *